United States Patent [19]

Tamba et al.

[11] Patent Number: 4,703,723

[45] Date of Patent: Nov. 3, 1987

[54] COMPRESSION RELEASE DEVICE FOR ENGINE

[75] Inventors: Shinichi Tamba; Noboru Fukui, both of Kakogawa; Akio Miguchi, Kobe, all of Japan

[73] Assignee: Kawasaki Jukogyo Kabushiki Kaisha, Japan

[21] Appl. No.: 879,950

[22] Filed: Jun. 30, 1986

[30] Foreign Application Priority Data

Jul. 9, 1985 [JP] Japan ..... 60-150565

[51] Int. Cl.[4] ..... F01L 13/08

[52] U.S. Cl. ..... 123/182; 123/188 AA; 123/193 H

[58] Field of Search ..... 123/182, 316, 188 AA, 123/188 AF, 193 CH, 193 H

[56] References Cited

U.S. PATENT DOCUMENTS 3,362,390 1/1968 Esty ..... 123/182

3,735,745 5/1973 Hatz ..... 123/182

*Primary Examiner*—Andrew M. Dolinar

*Attorney, Agent, or Firm*—Eric P. Schellin

[57] ABSTRACT

A compression release device for side-valve and overhead-valve internal combustion engines is disclosed, which takes advantages of the difference in thermal expansion of different materials to control the valve opening depending on the condition of ambient temperature. A first material of comparatively higher linear expansion coefficient is used for the cylinders and cylinder head, while a second material of comparatively lower expansion coefficient for the push rods and tappets for either or both of the intake and exhaust valves, with the valve or valves being set to take a valve lift enough to cause the valve, upon compression stroke, to remain properly slightly open at cold start to ease crankshaft rotation, while stay fully shut, as a result of the cylinders and cylinder head having undergone a greater degree of thermal expansion than the push rods and tappets, when the engine gets warmed up.

2 Claims, 2 Drawing Figures

COMPRESSION RELEASE DEVICE FOR ENGINE

BACKGROUND OF THE INVENTION

1. Field of the Invention

The present invention relates in general to a compression release device for side-valve and overheadvalve internal combustion engines, and, in more particular, to such a device which comprises a structural arrangement including the use of materials different in linear expansion on heating for the engine parts in such a manner as to cause either or both of the intake and exhaust valves, upon the compression stroke of the engine, to remain slightly open at cold starting, while stay fully closed when the engine temperature is sufficiently high, as a result of the parts having undergone a different rate of thermal expansion.

2. Description of the Prior Art

When starting the engine at cold state under low temperature environment, it is necessary for either or both of the intake and exhaust valves to remain slightly open on compression so as to lessen the degree of pressure in a cylinder, easing crankcase rotation until the engine is brought to sufficient acceleration. Furthermore, provision must be made to cause the intake and exhaust valves to stay fully closed upon each compression when the engine is sufficiently warmed up for normal running.

To solve this problem, various devices have so far been developed in the prior art. For example, the use of an eccentric cam is disclosed to cause the rocker arm to move down or the push rod to lift upward in such a manner to provide control of the valve opening. In some other instance, valve opening is controlled by a mechanism by which the tappet is lifted relative to its cam.

Another more improved system proposed in the prior art provides automatic valve opening control by governing the operation of the cam in response to its rate of rotation. Typical examples of these conventional art are disclosed by Takeshi Yoshida, Discourse on the Internal Combustion Engine (Earth Ltd., Nov. 5, 1980) p. 384 and in published Japanese patent application No. 53-37981.

However, these conventional devices have various problems. First, they have been incorporated into the engine valve system as an additional mechanism having parts relatively complicated in structure. This also have increased the overall engine weight and decreased serviceability, without mention of their difficulties in treatment.

SUMMARY OF THE INVENTION

The present invention contemplates to eliminate the above-mentioned various drawbacks of the prior art.

It is, therefore, a main object of the present invention to provide improved means for controlling the valve opening on engine cylinder compression depending on the condition of ambient temperature to thereby ease engine starting at cold state while ensuring proper running when the engine gets warmed in operation.

It is an additional object of the present invention to provide such means which is simple in structure contributing to reducing the overall engine size and weight.

The present invention proposes means by which, in a side-valve or overhead-valve, four-stroke cycle internal combustion engine, either or both of the intake and exhaust valves, upon the engine compression stroke, are caused to remain slightly open at a low environmental temperature while stay properly shut under normal running temperature.

This is achieved by the use of a first material of comparatively lower linear expansion for the push rods and tappets and a second material of comparatively higher linear expansion for the cylinder head and cylinders, with the valves being set to slightly open on compression at a low engine temperature, so as to ease the rotation of the crankshaft in cold engine starting.

When the engine is brought to normal running, resultant increased engine temperature causes the cylinder head and cylinders to more thermally expand than the push rods and tappets. This difference in thermal expansion of the operatively associated parts reduces the relative lift of the valve to its seat imbedded in the cylinder head to a point where the valve comes to stay shut properly upon compression.

The above and other objects, features and advantages of the present invention will become more apparent from the following description and appended claims taken in conjunction with the accompanying drawings which show by way of illustration a preferred embodiment of the invention.

DETAILED DESCRIPTION OF PREFERRED EMBODIMENTS

Figure 1:
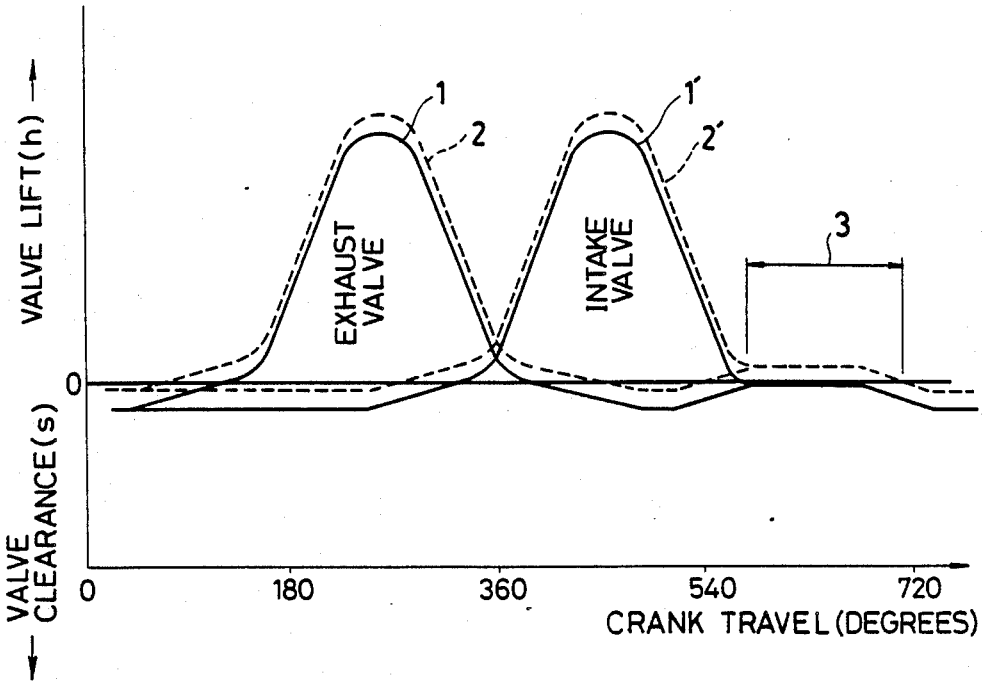
FIG. 1 is the lift-cranktravel diagram plotted to shown the performance of the intake and exhaust valves of a four-stroke cycle internal combustion engine incorporating a preferred embodiment of the means for controlling the valve opening according to the present invention.
Figure 2:
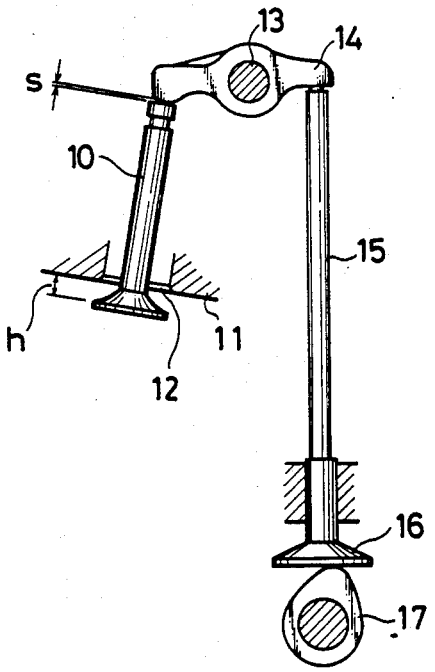
FIG. 2 is a side view of a valve mechanism for internal combustion engines.

Referring first to FIG. 1, which illustrates a valve mechanism for side-valve or overhead-valve, four-stroke cycle internal combustion engines, although the system and operation of engine valve mechanisms is well known, a brief explanation on it will be given in order to clarify the principal aspects of the present invention.

The depicted valve mechanism which may be one for intake or exhaust valves, comprises a valve seat 11 fixedly inbedded in the engine cylinder head, not shown, an axially movably disposed valve 10 for reciprocation relative to the valve seat 11, and a rocker arm 14 pivotally disposed for oscillation about the axis of a rocker arm shaft 13. A cam 17 is rotatably disposed for rotation about its own axis and, in operation, rotated by the engine crankshaft, not shown, to drive a tappet 16 up and down which, in turn, tilts the rocker arm 14 counterclockwise (in the drawing) by pushing its right end through a push rod 15.

The rocker arm 14 may be urged in a clockwise direction by a spring, not shown, to resume its original position when the push rod 15 moves down with the tappet 16 starting to follow the base circle of the cam. A clearance "S" is provided between the rocker arm 14 and the top of the valve 10 steam to permit the rocker arm 14 to gather required acceleration before it hits the valve 10.

With the above arrangement, the rocker arm 14, driven by the crankshaft through the cam 17, oscillates back and forth causing the valve 10 in reciprocation to open and close its opening, designated at 12.

The valve 10 is depicted at its opened state for suction of the mixture of fuel and air (in the case of the intake valve) or discharging the exhaust gases (in the case of the exhaust valve) after the explosion stroke. When the engine is on the compression stroke, on the other hand, the valve, whether intake or exhaust, is moved upward to close the opening 12 for subsequent maximum engine performance.

The valve lift "h" is defined as the distance of travel of the valve between its upper (fully closed) position determined by the tappet 16 contacting the base circle of the cam 17 and its lower (fully opened) position when the tappet 16 is in contact with the highest point of the cam lobe.

Although the valve 10 should remain fully closed on the compression stroke when the engine is normally running, it is necessary for the valve to be kept slightly open during the compression stage to ease the rotation of the crankshaft when the engine is started at cold state, particularly when the environment is at low temperatures.

With the increasing temperature of the engine as it continues running, the thermal effect on the valve mechanism and cylinders causes different elongations of the various parts. It is known in physics that different materials undergo a different rate of elongation upon heating. The present invention takes advantage of this difference in linear expansion coefficient between different materials by the use of a combination of materials for the engine parts, the one of comparatively higher linear expansion coefficient for the cylinder head and cylinders and the other material of comparatively lower linear expansion coefficient for the push rods and tappets in such a manner that each valve is allowed to take a greater valve lift than conventional causing the valve to slightly open upon compression when the environment is at low temperatures, since the engine parts all have yet cause no or little thermal expansion. Consequently, the rotation of the crankshaft will be eased until the engine is sufficiently warmed up.

When the engine has entered a normal running condition, with a resultant increase in engine temperature, the cylinder head and cylinders undergo a greater rate of thermal linear expansion than the push rods and tappets, reducing the distance of travel the valve has to cover to reach to its fully closed position upon engine compression. Thus, once the engine starts normal running, the valves are allowed to fully close upon each compression for optimum engine performance.

The following table present the different combinations of materials for the engine parts with a corresponding practically applicable valve lift which might be set during the valve mechanism assembly to cause the valve to properly slightly open on compression stroke when the engine is started under low temperature condition. Computation of the valve lift for each set of material combination were based on the assumption that the cylinder head, the cylinders, the push rods and the tappets were at −30° C. as a starting temperature and, as a normal engine temperature, the cylinder head and the cylinder heads were at 100° C. while the rest at 80° C., with the total length of the tappet and push rod assembly being 170 mm.

| Cylinder head and cylinder | | Push rod and tappet | | Lift for proper valve opening on compression at cold starting temperature |
|---|---|---|---|---|
| Material | Linear expansion coefficient | Material | Linear expansion coefficient | |
| Combinations according to the present invention | | | | |
| 1. aluminium die casting ADC 10, 12 | $2.31 \times 10^{-5}$ | Invar alloy (Fe 64%, Ni 36%) | $0.12 \times 10^{-5}$ | 0.49 mm |
| 2. Aluminium die casting ADC 10, 12 | $2.31 \times 10^{-5}$ | Ceramics (alumina) | $0.55 \times 10^{-5}$ | 0.41 mm |
| 3. Aluminum die casting ADC 10, 12 | $2.31 \times 10^{-5}$ | Glass | $0.85 \times 10^{-5}$ | 0.35 mm |
| 4. Aluminium die casting ADC 10, 12 | $2.31 \times 10^{-5}$ | S40 through 50C | $1.20 \times 10^{-5}$ | 0.29 mm |
| 5. Cast iron FC25 through 45 | $1.06 \times 10^{-5}$ | Invar alloy (Fe 64%, Ni 36%) | $0.12 \times 10^{-5}$ | 0.21 mm |
| 6. Cast iron FC25 through 45 | $1.06 \times 10^{-5}$ | Ceramics (alumina) | $0.55 \times 10^{-5}$ | 0.13 mm |
| Conventional combinations | | | | |
| 7. Cast iron FC25 through 45 | $1.06 \times 10^{-5}$ | S40 through 50C | $1.20 \times 10^{-5}$ | 0.01 mm |
| 8. Aluminium die casting ADC 10, 12 | $1.06 \times 10^{-5}$ | A2011 | $2.40 \times 10^{-5}$ | 0.06 mm |

From the above table, it will easily be seen that combinations 1 through 6 enable the valve mechanism to ensure a greater amount of valve lift, compared with prior art combinations 7 and 8, enough to cause the valve, upon the compression stroke, to remain properly slightly open under low temperature environment as at cold start and, when the engine starts running in normal condition, stay fully shut for efficient performance.

Referring then to FIG. 1, which is the lift-cranktravel diagram plotted to show the performance of a valve mechanism embodying the present invention, valve lift "h" taken along the axis of ordinate and cranktravel, rotational degree along the axis of abscissa, the exhaust valve, on compression, while taking a greater amount of valve lift at low ambient temperature (as represented by line 1) so as to ease rotation of the crankshaft, follows a curve of smaller valve lift (as by line 2). Similarly, lines 1' and 2' represent the performance of the intake valve under corresponding temperature environments.

Also, in FIG. 1, span 3 indicates the period during which the intake and exhaust valves are caused to remain properly slightly open on the compression stroke at cold start. In the diagram, valve clearance "S" is taken on the axis of ordinate below the base line.

Various changes and modifications may be possible without departing from the spirit of the present invention. It is important to note, therefore, that this invention should be limited, not by the above particular description and accompanying drawings, which are given only by way of illustration, but by the scope of the appended claims.

What is claimed is:

1. A compression release device for sidevalve and overhead-valve internal combustion engines, comprising the use of a first material of comparatively lower linear thermal expansion for push rods and tappets for either of the intake and exhaust valves and a second material of higher linear thermal expansion for the cylinder head and cylinders, with the valve for said push rods and tappets using said first material being set to have a valve lift that causes said valve, upon the compression stroke, to remain slightly open enough to ease rotation of the crankshaft at cold start, while staying fully closed when the engine is sufficiently warmed up to ensure efficient engine performance.

2. A compression release device as set forth in claim 1, wherein said first material is used for said push rods and tappets for both said intake and exhaust valves, with both said valves each being set to have a valve lift that causes the respective valve, upon the compression stroke, to remain slightly opened enough to ease rotation of the crankshaft at cold start, while staying fully closed when the engine is sufficiently warmed up to ensure efficient engine performance.

* * * * *